United States Patent [19]

Pera et al.

[11] Patent Number: 4,498,382

[45] Date of Patent: Feb. 12, 1985

[54] SCREW PRESS FOR GRAPE CROP

[75] Inventors: Jean Pera, Florensac; Didier Pera, Montblanc, both of France

[73] Assignee: Societe S.O.M.A.V.I., Florensac, France

[21] Appl. No.: 505,634

[22] Filed: Jun. 20, 1983

[30] Foreign Application Priority Data

Mar. 28, 1983 [FR] France ..... 83 05068

[51] Int. Cl.[3] ..... B30B 9/14

[52] U.S. Cl. ..... 100/117; 100/127; 100/148

[58] Field of Search ..... 100/117, 145, 146, 147, 100/148, 149, 150, 126, 127, 128, 129

[56] References Cited

U.S. PATENT DOCUMENTS 1,630,430 5/1927 Holter et al. ..... 100/145

FOREIGN PATENT DOCUMENTS 529680 7/1931 Fed. Rep. of Germany .
508910 8/1920 France .
583757 1/1925 France .
604679 1/1926 France .
606980 6/1926 France .
1022579 3/1953 France .
499020 11/1954 Italy ..... 100/117

*Primary Examiner*—Peter Feldman
*Attorney, Agent, or Firm*—Karl W. Flocks; Sheridan Neimark

[57] ABSTRACT

The invention provides a helical screw press for processing grape crop in which a filter tube diverges from a predetermined section of its length in downstream direction such that the divergence enables the grapes to be released and prevents formation of an impermeable crust in the filtering tube thereby permitting total pressing and increased flow rate.

2 Claims, 4 Drawing Figures

SCREW PRESS FOR GRAPE CROP

This invention relates to screw presses for processing grape crop.

Generally, in the known helical screw presses the grape-crop reaches a receiving hopper so as to be taken up by a screw which conveys and compresses the grapes in a compression chamber in a continuous rotational motion or a translational and rotational alternate motion. The juice flows out through grids and a marc cake dries as it is being passed through said compression chamber, and moves out in a dry condition at one end of the machine, a door being used as a retaining means therefor (see FIG. 1 in the attached drawing).

In this type of machine, the main pressing action is exerted in the compression chamber and consequently through grids that form together a kind of tube means.

As a matter of fact, as the grape crop moves on in said chamber the juice contained in the grape crop flows out through grids and this mechanical juice flow phenenomenon is only possible because of the self-filtering capacity of the grapes.

The presses are obviously designed for optimum utilization of the grids which constitute a filter or a filter tube.

However, grapes are made of a living material so that their physico-chemical composition is variable depending on certain natural factors such as sunshine or rain fall before the harvest or depending on certain artificial factors such as fermentation processes.

In certain cases that cannot be determined scientifically the socalled tunnelling phenomenon occurs in the compression chamber. The grape crop then loses its self-filtering capacity and adheres to the grids so as to form an impermeable crust (a). The remainder of the grape crop (b) can no longer totally express its juice and the product that moves out from (c) is still moist (see FIG. 2 in the attached drawing). The press therefore does not totally realize its function.

This invention remedies such disadvantage by providing a helical screw press for processing grape crop in which the filter tube diverges from a determined section of its length in downstream direction such that the divergence enables the grapes to be released and prevents formation of said impermeable crust in the filtering tube thereby permitting total pressing and increased flow rate.

According to a particularly advantageous form of embodiment, a first section of the filtering tube is cylindric up to the end of the screw and a second section of the filtering tube is conical starting from a diameter equal to the first section and terminated at a greater diameter at the outlet.

As explained above, depending on the variable composition of the grape crop, the obstruction plug or marc cake reaching the outlet may therefore be more or less broken up and in certain cases is in such a physical condition that the retaining door can control it only with difficulty.

Thus, according to another form of embodiment of the invention there is provided a cylindric section between the conical section and the outlet to permit reconstitution of the marc cake. Thus, the retaining door can control it in a substantially improved manner.

Other characteristics and advantages of this invention will appear from the following description of forms of embodiment of this invention which is made with reference to the attached drawing on which:

Figure 1:
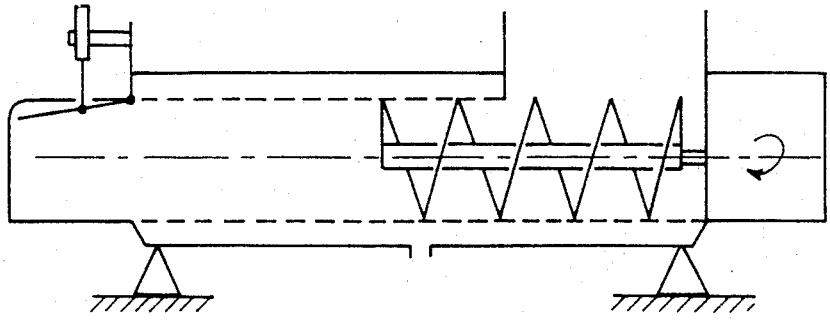
FIG. 1 is a schematic longitudinal cross-sectional view of a known helical screw press.
Figure 2:
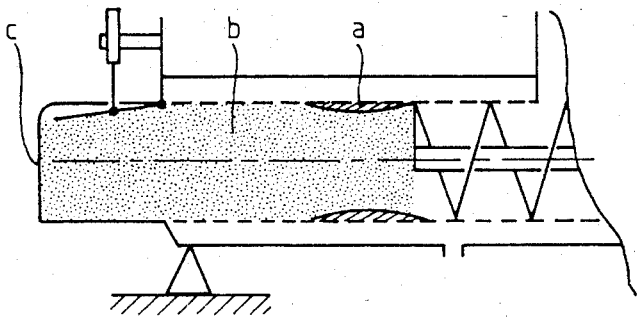
FIG. 2 is a partial longitudinal cross-sectional view of the same press showing the impermeable crust which is produced in the filter tube.
Figure 3:
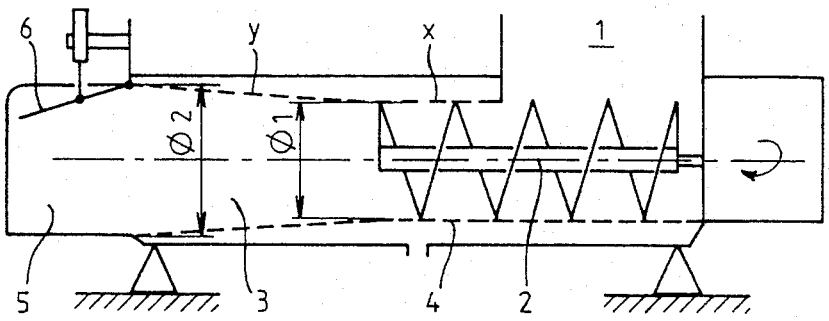
FIG. 3 is a longitudinal cross-sectional view of one form of embodiment of a helical screw press according to the invention.

In the form of embodiment shown in FIG. 3, a helical screw press according to the invention comprises in a known manner a hopper for receiving the grape crop 1 and a helical screw 2 which conveys and compresses the grapes in a compression chamber 3, the juice therefrom flowing out through grids 4. The press also comprises an outlet end 5 for the marc cake and a retaining door 6.

In accordance with this invention, the filter tube formed by the grids comprises a first cylindric section (x) extending up to the upstream end of the screw and a second conical diverging section (y) starting from a diameter $\phi 1$ equal to the diameter of the first section and terminated by a higher diameter $\phi 2$ at the outlet 5.

The diverging or conical shape of the filter tube enables the grapes to be released and prevents formation of the impermeable crust (a) thereby resulting in total pressing and increased flow rate.

Figure 4:
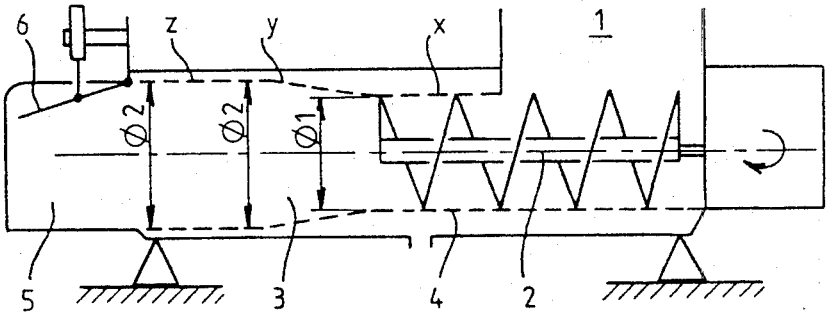
FIG. 4 is a longitudinal cross-sectional view of another form of embodiment of a helical screw press according to the invention.

In the form of embodiment shown in FIG. 4, the grids of the filter tube comprise in the same way as in the form of embodiment shown in FIG. 3, a first cylindric section (x) and a second divergent or conical section (y).

The marc cake is reconstituted at the outlet of the press whatever be the composition of the grape crop by providing a third cylindric section (z) in the filter tube between the divergent or conical section (y) and the outlet 5. In other terms, said third cylindric section (z) follows the second divergent or conical section (y) and is of a diameter which is the same as the downstream diameter $\phi 2$ of the conical section (y).

We claim:

1. A screw press comprising a hopper for reception of grape crop, a compression chamber, a helical screw which conveys and compresses grapes in said compression chamber, an outlet end, grids and a filter tube formed from said grids, said filter tube including a first cylindric section extending up to the downstream end of the screw and a second divergent or conical section starting from a diameter equal to the diameter of the first section and terminated by a higher diameter at the outlet end and a third cylindric section between said divergent or conical section and said outlet end, said third cylindric section having a length such that the marc cake is reconstituted at said outlet end of the press whatever be the composition of the grape crop, said filter tube diverging from a determined section of its length in the downstream direction such that said divergence enables the grapes to be freed and prevents formation of an impermeable crust in the filtering tube thereby resulting in total pressing and increased flow rate.

2. A press according to claim 1, wherein said cylindric section is of a diameter which is the same as the downstream diameter of said conical section.

* * * * *